United States Patent [19]

Mukunoki et al.

[11] Patent Number: 4,891,307

[45] Date of Patent: Jan. 2, 1990

[54] SILVER HALIDE PHOTOGRAPHIC MATERIAL

[75] Inventors: Yasuo Mukunoki; Yukio Maekawa; Shuzo Suga, all of Kanagawa, Japan

[73] Assignee: Fuji Photo Film Co., Ltd., Kanagawa, Japan

[21] Appl. No.: 368,949

[22] Filed: Jun. 13, 1989

Related U.S. Application Data

[63] Continuation of Ser. No. 178,814, Mar. 28, 1988, abandoned, which is a continuation of Ser. No. 929,021, Nov. 10, 1986, abandoned.

[30] Foreign Application Priority Data

Nov. 8, 1985 [JP] Japan ..... 60-249021

[51] Int. Cl.[4] ..... G03C 1/82

[52] U.S. Cl. ..... 430/527; 430/523; 430/531; 430/631; 430/637

[58] Field of Search ..... 430/523, 527, 531, 631, 430/637

[56] References Cited

U.S. PATENT DOCUMENTS

| | | | |
|---|---|---|---|
| 4,165,237 | 8/1979 | Shiba et al. | 430/523 |
| 4,267,265 | 5/1981 | Sugimoto et al. | 430/523 |
| 4,272,015 | 6/1981 | Yoneyama et al. | 430/527 |
| 4,292,402 | 9/1981 | Pollet et al. | 430/537 |
| 4,304,852 | 12/1981 | Sugimoto et al. | 430/529 |
| 4,330,618 | 5/1982 | Minamizono et al. | 430/523 |
| 4,347,308 | 8/1982 | Takeuchi et al. | 430/634 |
| 4,407,937 | 10/1983 | Sugimoto et al. | 430/527 |
| 4,474,873 | 10/1984 | Maekawa et al. | 430/538 |
| 4,508,764 | 4/1985 | Zeides | 430/631 |
| 4,596,766 | 6/1986 | Nemori et al. | 430/527 |
| 4,609,489 | 9/1986 | Hisamoto et al. | 430/631 |
| 4,649,102 | 3/1987 | Mukunoki et al. | 430/527 |

OTHER PUBLICATIONS

Abstract of French Patent 2272416 4/1977, Fuji Photo Film KK.

*Primary Examiner*—Jack P. Brammer

*Attorney, Agent, or Firm*—Sughrue, Mion, Zinn, Macpeak & Seas

[57] ABSTRACT

A silver halide photographic material is disclosed. The material is comprised of a support having thereon at least one silver halide emulsion layer, wherein at least one of the silver halide emulsion layer and another constituent layer contains a fluorine-containing nonionic surface active agent, a fluorine-containing ionic surface active agent and a fluorine-free nonionic surface active agent.

5 Claims, No Drawings

SILVER HALIDE PHOTOGRAPHIC MATERIAL

This is a continuation of application Ser. No.178,814, filed 3/28/88 which is a continuation of application Ser. No. 929,021 filed 11/10/86, both now abandoned.

FIELD OF THE INVENTION

The present invention relates to a silver halide photographic emulsion having excellent antistatic properties. More particularly, the present invention relates to a silver halide photographic material (hereinafter referred to as "photographic light-sensitive material") having less static electricity against various elements and further excellent antistatic properties after storage for a period of time.

BACKGROUND OF THE INVENTION

Since photographic light-sensitive materials generally comprise a support and photographic light-sensitive layers having electrical insulation properties, they are often susceptible to accumulation of static electricity due to contact friction against or peeling from the surface of the same or different kind of element upon their manufacture and use. Static electricity thus accumulated causes many troubles. One of the most serious troubles is that the light-sensitive emulsion layer is exposed to light by the discharge of static electricity which has been accumulated before development. When the photographic film is developed, this causes formation of dot-like spots, or branch-like or feather-like line spots thereon. These spots are so-called static marks which remarkably or, sometimes, totally mar the commercial value of the photographic film. It can be readily understood that such static marks developed on medical or industrial X-ray films, for example, lead to extremely dangerous misjudgments. Such static marks occurred in color photographic light-sensitive materials will mar the memorial value. Since such an accident appears only when the photographic light-sensitive material is developed, static mark is one of very difficult problems in this field. Such static electricity thus accumulated also causes the surface of the film to attract dust or makes it difficult to make a uniform coating to the film.

As described above, such static electricity is often accumulated in photographic light-sensitive materials upon its manufacture and use. For example, in the manufacture, static electricity is generated by contact friction between the photographic film and the roller or peeling of the support from the emulsion layer during the winding or rewinding of the photographic film. Furthermore, static electricity is generated by the separation of the base from the emulsion layer when the finished product is rewound on another reel. Moreover, static electricity is generated when an X-ray film is brought into contact with and then separated from a mechanical part or a fluorescent-sensitized paper in an automatic photographic apparatus.

In color negative films and color reversal films, static electricity is generated when they are brought into contact with and then separated from a connecting machine in a camera or a developing facility, or a rubber, metal or plastic roller bar in an automatic developing machine.

Static electricity is also generated when the photographic light-sensitive material is brought into contact with packing materials. Static marks developed by such a static electricity accumulation become more remarkable when the sensitivity and the treatment speed of the photographic light-sensitive material is increased. In recent years, the photographic light-sensitive materials have been improved more and more in its sensitivity, coating speed, photographing speed, and automatic development speed. Furthermore, the photographic light-sensitive materials have been more often subjected to exposure to low humidity. These severe handling conditions make the photographic light-sensitive materials more susceptible to static marks.

In order to eliminate such troubles due to static electricity, it is preferable that antistatic agents be incorporated in the photographic light-sensitive materials. However, as antistatic agents to be used in the photographic light-sensitive materials, antistatic agents which are commonly used in other fields cannot always be applied. The use of such antistatic agents is subject to various restrictions peculiar to the photographic light-sensitive materials. Particularly, besides being excellent in antistatic properties, such antistatic agents which may be used for the photographic light-sensitive materials must satisfy various requirements. For example, such antistatic agents must not have harmful effects on the photographic properties of the photographic light-sensitive materials such as sensitivity, fog, graininess, and sharpness; they must not deteriorate the film strength of the photographic light-sensitive materials (i.e., insusceptibility to scratch due to friction or scratching); they must not have harmful effects on the anti-adhesive property of the photographic light-sensitive materials (i.e., insusceptibility to adhesion between surfaces of the photographic light-sensitive materials or to the surface of other materials). Such antistatic agents are also required not to accelerate fatigue of the treating solution in the photographic light-sensitive materials, soil the conveying roller, and lower the adhesion between the constituent layers of the photographic light-sensitive materials. Thus, the application of antistatic agents to the photographic light-sensitive materials is subjected to a very large number of restrictions.

One of the approaches to eliminate troubles due to static electricity is to raise the electric conductivity of the surface of a light-sensitive material so that static electricity can be scattered and lost in a short period of time before being discharged.

Therefore, methods of improving the electric conductivity of the support and various coated surface layers of the photographic light-sensitive materials have heretofore been carried out. In these methods, the application of various hygroscopic materials and water-soluble inorganic salts, and some kinds of surface active agents and polymers have been attempted. Examples of known materials which have been attempted to be used include polymers as described in U.S. Pat. Nos. 2,882,157, 3,262,807, and 3,938,999, surface active agents as described in U.S. Pat. Nos. 2,982,651, 3,457,076, and 3,655,387, and metal oxides and colloid silica as described in U.S. Pat. Nos. 3,062,700 and 3,525,621.

However, most of these materials show some specificity against specific kinds of supports and photographic compositions. That is to say, these materials give good results against specific supports and photographic emulsions and other photographic constituent elements of the photographic light-sensitive materials, but may not only be no use in antistatic effect but also give harmful effects on the photographic properties when used in other supports and photographic constituent elements of the photographic light-sensitive materials.

On the other hand, there are some antistatic agents which have very excellent antistatic properties but cannot be used due to harmful effects on the photographic properties such as sensitivity, fog, graininess and sharpness of the photographic emulsion. For example, polyethylene oxide compounds are generally known to have antistatic properties.

In order to obtain satisfactory antistatic properties by the use of polyethylene oxide compounds alone, however, it is necessary to add a large amount thereof, and in so doing it often gives harmful effects on the photographic properties such as increase of fog, desensitization, and deterioration of graininess. Also upon development, it is liable to be stained, and coating at high speed causes troubles such as repelling, or the like. In particular, it has been difficult to establish a technique effectively providing antistatic properties to a light-sensitive material comprising a support coated with a photographic emulsion on both sides thereof, such as medical direct X-ray light-sensitive material, without giving harmful effects on the photographic properties. Thus, it is very difficult to apply antistatic agents to photographic light-sensitive materials. Furthermore, the use of antistatic agents is often limited.

Another approach to eliminate troubles on the photographic light-sensitive materials due to static electricity is to reduce the capability of the surface of the photographic light-sensitive material to generate static electricity so that the generation of static electricity due to friction or contact can be minimized.

To this end, the use of fluorine-containing ionic surface active agents as described in British Pat. Nos. 1,330,356 and 1,524,631, U.S. Pat. Nos. 3,666,478, 3,589,906, and 3,850,642, Japanese patent publication No. 26687/77, and Japanese patent application (OPI) Nos. 46733/74, 32322/76, 84712/78, 14224/79, 52223/73, 127974/77, and 200235/83 (the term "OPI" as used herein means an "unexamined published Japanese patent application") in the photographic light-sensitive materials have been attempted.

However, photographic light-sensitive materials containing these fluorine-containing ionic surface active agents have a static property such that when brought into contact with various materials, they generally show negative-electrification property against these materials. It is possible to reduce the capability of these photographic light-sensitive materials to generate static electricity against a rubber roller, Derlin roller, nylon bar, etc., by incorporating coating agents having positive-electrification property against these various elements in the photographic light-sensitive materials. However, it is impossible to simultaneously reduce the capability of the light-sensitive materials to generate static electricity against all these elements with which the light-sensitive materials are brought into contact. For example, if the capability of the light-sensitive materials to generate static electricity against rubber is reduced, it is usual that branch-like static marks are generated due to Derlin or the like, which is positioned at the positive side of rubber in the electrification series. On the contrary, if the capability of the light-sensitive materials to generate static electricity against Derlin is reduced, it is usual that spot-shaped static marks are generated due to rubber or the like, which is positioned at the negative side of Derlin in the electrification series.

These fluorine-containing ionic surface active agents deteriorate coating properties. Furthermore, photographic light-sensitive materials containing the fluorine-containing ionic surface active agents are susceptible to change in its capability of generating static electricity during storage after manufacture. Thus, these fluorine-containing ionic surface active agents cannot be easily put into practical use with light-sensitive materials.

Furthermore, the use of fluorine-containing nonionic surface agents is disclosed in Japanese patent application (OPI) No. 61236/75 and U.S. Pat. No. 4,175,969.

In accordance with these patents, the dependence of the photographic light-sensitive materials on the elements with which they are brought into contact can be slightly reduced by adding a large amount of these surface active agents thereto. However, since the use of a large amount of these surface active agents causes a drastic reduction of sensitivity, adhesion between films and stain upon development, these surface active agents cannot be put into practical use.

SUMMARY OF THE INVENTION

An object of the present invention is, therefore, to provide a photographic light-sensitive material which has antistatic property so that its capability of generating static electricity against various elements can be reduced.

Another object of the present invention is to provide a photographic light-sensitive material which maintains its stable electrification property even when the manufacturing condition is altered.

Further object of the present invention is to provide a photographic light-sensitive material which maintains its antistatic property even with the passage of time after manufacture.

Still further object of the present invention is to provide a photographic light-sensitive material which has antistatic property so that it is not stained upon development.

Yet another object of the present invention is to provide a photographic light-sensitive material which can provide a homogeneous suspension of a photographic coating solution thereon without causing "repelling" and "comet" when the photographic coating solution containing or free of various photographic binders such as gelatin is coated at high speed.

These objects of the present invention are accomplished by a silver halide photographic material comprising a support having thereon at least one silver halide emulsion layer, wherein at least one of the silver halide emulsion layer and another constituent layer contains a fluorine-containing nonionic surface active agent, a fluorine-containing ionic surface active agent, and a fluorine-free ionic surface active agent.

DETAILED DESCRIPTION OF THE INVENTION

It was quite unexpectable that such combined use of three kinds of surface active agents, at least one kind of fluorine-containing nonionic surface active agent, at least one kind of fluorine-containing ionic surface active agent, and at least one kind of fluorine-free nonionic surface active agent, could improve the antistatic property, production stability, prevention of stain upon development, and photographic properties.

Examples of fluorine-containing nonionic surface active agents which may be used in the present invention include those described in Japanese patent application (OPI) Nos. 10722/74, 84712/78, 14224/79, and 113221/75, and British Pat. No. 1,330,356.

Preferred examples of fluorine-containing non-ionic surface active agents which may be used in the present invention include compounds having a fluoroalkyl, fluoroalkenyl, or fluoroaryl group, having 4 or more carbon atoms and a substituted or unsubstituted polyoxyalkylene group having 2 to 8 carbon atoms, polyglyceryl group or sorbitan residual group as a nonionic group.

More preferred examples of fluorine-containing non-ionic surface active agents which may be used in the present invention are represented by formula (I):

$$Rf\text{-}(A)_a\text{-}(\overset{R_1}{\overset{|}{N}})_n\text{-}(B)_b\text{-}(D)_d \qquad (I)$$

wherein Rf represents a perfluoroalkyl, perfluoroaryl, or perfluoroalkenyl group, having 4 to 20 carbon atoms; $R_1$ represents a hydrogen atom, or a substituted or unsubstituted alky, or alkenyl group; A represents —CO—, —COO—, —SO—, —So₂—, or —OCO—; B represents a substituted or unsubstituted alkylene, aralkylene, or arylene group [preferably,

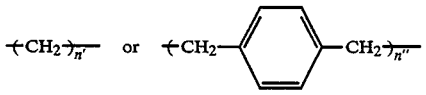

(n′ and n″ each is 1 to 20)]; D represents a substituted or unsubstituted oxyalkylene group (preferably, oxyethylene, oxyhydroxypropylene, oxypropylene, or a mixture thereof); a and n each represents 0 or 1; b represents 0, 1, or 2; and d represents 2 to 50 (preferably, 5 to 25).

Most preferred examples of fluorine-containing non-ionic surface active agents include those having a perfluoroalkyl, perfluoroalkenyl, or perfluoroaryl group, having 6 to 14 carbon atoms and a substituted or unsubstituted polyoxyethylene group (preferably having a number of 5 to 50, and more preferably 6 to 25, of the average degree of polymerization of oxyethylene group) as a nonionic group.

Specific examples of fluorine-containing nonionic surface active agents are shown below.

$C_7F_{15}COO(CH_2CH_2O)_{10}H$ I-1

$C_{10}F_{21}COO(CH_2CH_2O)_{10.5}H$ I-2

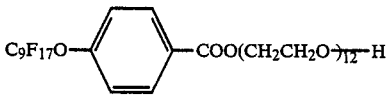

I-3

$C_8F_{17}SO_2N(CH_3)(CH_2CH_2O)_9H$ I-4

$C_8F_{17}SO_2N(C_{10}H_{21})(CH_2CH_2O)_{12.5}H$ I-5

$C_6F_{13}SO_2N[(CH_2CH_2O)_nH][(CH_2CH_2O)_mH]$ I-6 n + m = 11.5

-continued $C_8F_{17}N(C_3H_7)(CH_2CH_2O)_{15}H$ I-7

$C_8F_{17}SO_2N(C_2H_5)CH(CH_3)CH_2O(CH_2CH_2O)_{13.5}H$ I-8

$C_8F_{17}CH_2CH_2O(CH_2CH_2O)_{12.5}H$ I-9

$C_8F_{17}SO_2N(C_3H_7)CH_2COO(CH_2CH_2O)_{9.5}H$ I-10

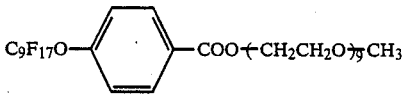

I-11

$C_9F_{19}O(CH_2CH_2O)_9CH_3$ I-12

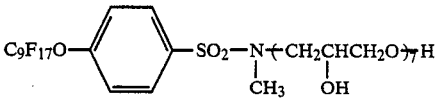

I-13

$C_7F_{15}COO(CH_2CH(CH_3)O)_4(CH_2CH_2O)_{20}H$ I-14

$CF_3C(C_2F_5)_2C(CF_3)(CH_2O(CH_2CH_2O)_7H)CHF-CF_3$ I-15

$H(CF_2)_6CH_2O-CH_2CH(O(CH_2CH_2O)_8H)CH_2O-CH_2CF_2CF_2H$ I-16

$C_8F_{17}SO_2N(C_3H_7)(CH_2CH(OH)CH_2O)_2(CH_2CH_2O)_{10}H$ I-17

The fluorine-containing ionic surface active agents of the present invention include an anionic, betainic, and cationic fluorine-containing ionic surface active agent. Examples of such fluorine-containing ionic surface active agents are described in U.S. Pat. Nos. 4,335,201 and 4,347,308, British Pat. Nos. 1,417,915 and 1,439,402, Japanese patent publication Nos. 26687/77, 26719/82 and 38573/84, and Japanese patent application (OPI) Nos. 149938/80, 48520/79, 14224/79, 200235/83, 146248/82, and 196544/83.

Preferred examples of fluorine-containing ionic surface active agents which may be used in the present invention include surface active agents having a fluoroalkyl, fluoroalkenyl, or fluoroaryl group, having 4 or more carbon atoms and ionic groups such as anionic group (e.g., sulfonic acid, sulfonate, sulfuric acid, sulfate, carboxylic acid, carboxylate, phosphoric acid, and phosphate), cationic groups (e.g., amine salt, ammonium salt, aromatic amine salt, sulfonium salt, and phosphonium salt), and betainic group (e.g., carboxyamine salt, carboxyammonium salt, sulfonamine salt, sulfoammonium salt, and phosphoammonium salt).

More preferred examples of fluorine-containing ionic surface active agents which may be used in the present invention are represented by formula (II):

$$Rf\text{-}(A)_a\text{-}(\overset{\overset{R_1}{|}}{N})_n\text{-}(B)_b\text{-}(E)_e \qquad \text{(II)}$$

wherein Rf, $R_1$, A, B, a, n, and b each has the same meaning as defined with the formula (I); E represents an ionic hydrophilic group such as an anionic, cationic, and betainic group; and e represents 1 or 2.

The preferred compounds represented by E in the formula (II) include a sulfate, a sulfonate, a carboxylate, a phosphate, a carboxybetainic group, a sulfobetainic group, and an ammonium group.

Particularly preferred compounds represented by E in the formula (II) include a sulfate, a sulfonate, a carboxylate, a phosphate, and a trialkylammonium salt (wherein the trialkyl group includes a substituted or unsubstituted alkyl, alkenyl, or aryl group, having 1 to 8 carbon atoms such as trimethyl, triethyl, trihydroxyethyl, benzyldimethyl group, etc.).

Most preferred fluorine-containing ionic surface active agents include fluorine-containing ionic surface active agents having a perfluoroalkyl, perfluoroalkenyl, or perfluoroaryl group, having 6 to 14 carbon atoms.

Specific examples of such preferred fluorine-containing ionic surface active agents are shown below.

$C_8F_{17}SO_3K$ II-1

$C_7F_{15}COONa$ II-2

$C_8F_{17}CH_2CH_2OSO_3Na$ II-3

$C_8F_{17}SO_2\overset{\overset{C_3H_7}{|}}{N}-CH_2COOK$ II-4

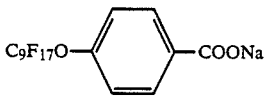
II-5

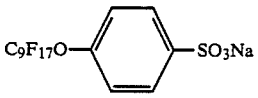
II-6

$C_8F_{17}SO_2\overset{\overset{C_3H_7}{|}}{N}\text{-}(CH_2CH_2O)_4\text{-}(CH_2)_4SO_3Na$ II-7

$C_8F_{17}SO_2\overset{\overset{C_3H_7}{|}}{N}CH_2CH_2O-\overset{\overset{O}{\|}}{\underset{\underset{ONa}{|}}{P}}-ONa$ II-8

$C_{10}F_{17}COOCH_2\underset{\underset{OH}{|}}{C}HCH_2SO_3Na$ II-9

$H(CF_2)_6CH_2OOC-CH_2$
$H(CF_2)_6CH_2OOC-\underset{|}{C}H-SO_3Na$ II-10

$C_8F_{17}CH_2CH_2OOC-CH_2$
$C_4H_9OOC-\underset{|}{C}H-SO_3Na$ II-11

$C_8F_{17}SO_2\overset{\overset{H}{|}}{N}CH_2CH_2-\overset{\overset{CH_3}{|}}{\underset{\underset{CH_3}{|}}{\oplus N}}-CH_2COO^{\ominus}$ II-12

$C_8F_{17}SO_2\overset{\overset{H}{|}}{N}CH_2CH_2CH_2OCH_2CH_2-\overset{\overset{CH_3}{|}}{\underset{\underset{CH_3}{|}}{\oplus N}}-CH_2COO^{\ominus}$ II-13

$C_8F_{17}SO_2\overset{\overset{H}{|}}{N}CH_2CH_2CH_2OCH_2CH_2-\overset{\overset{CH_3}{|}}{\underset{\underset{CH_3}{|}}{\oplus N}}-CH_2CH_2COO^{\ominus}$ II-14

-continued

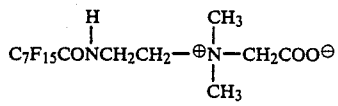
II-15

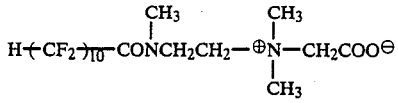
II-16

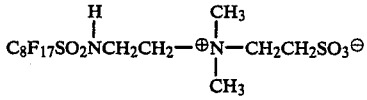
II-17

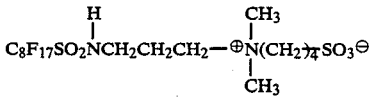
II-18

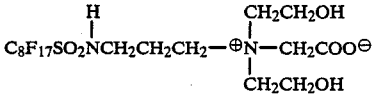
II-19

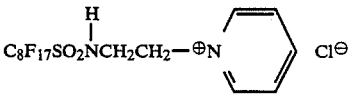
II-20

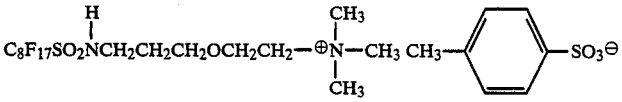
II-21

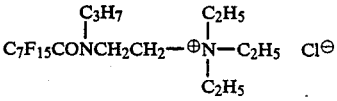
II-22

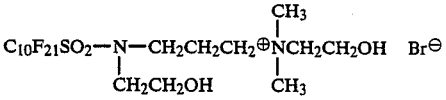
II-23

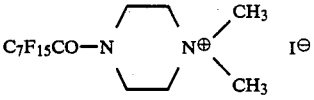
II-24

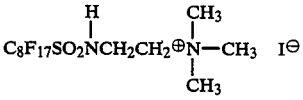
II-25

Examples of fluorine-free nonionic surface active agents which may be used in the present invention are represented by formula (III), (III′) or (III″):

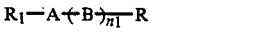
(III)

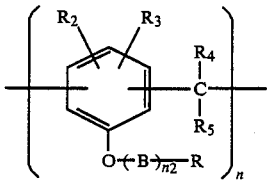
(III′)

-continued

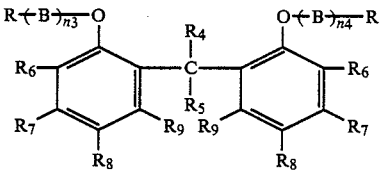
(III″)

wherein R represents a hydrogen atom, an alkyl group having 1 to 4 carbon atoms (such as methyl, ethyl, hydroxyethyl, etc.), or an alkylcarbonyl group having 1 to 5 carbon atoms (such as acetyl, chloroacetyl, carboxymethylcarbonyl etc.); $R_1$ represents a substituted or unsubstituted alkyl, alkenyl or aryl group, having 1 to 30 carbon atoms; A represents —O—, —S—, —COO—, $$-\underset{|}{N}-R_{10},\ -CO-\underset{|}{N}-R_{10},\ \text{or}\ -SO_2\underset{|}{N}-R_{10}$$

(wherein $R_{10}$ represents a hydrogen atom, or a substituted or unsubstituted alkyl group); B represents an oxyalkylene group having 8 or less carbon atoms; $R_2$, $R_3$, $R_7$ and $R_9$ each represents a hydrogen atom, or a substituted or unsubstituted alkyl, aryl, alkoxy or aryloxy group, a halogen atom, an acyl group, an amide group, a sulfonamide group, a carbamoyl group, or a sulfamoyl group; $R_6$ and $R_8$ each represents a substituted or unsubstituted alkyl, aryl, alkoxy, or aryloxy group, a halogen atom, an acyl group, an amide group, a sulfonamide group, a carbomoyl group, or a sulfamoyl group; $R_4$ and $R_5$ each represents a hydrogen atom, a substituted or unsubstituted alkyl or aryl (including furyl) group; $R_4$ and $R_5$, $R_6$ and $R_7$, and $R_8$ and $R_9$ may form a substituted or unsubstituted ring when taken together; $n_1$, $n_2$, $n_3$, and $n_4$ each represents the average degree of polymerization of oxyalkylene group, which is a number of 2 to 50; and m represents the average degree of polymerization, which is a number of 2 to 50.

The substituent group of the phenyl ring in the formula (III") may be bilaterally asymmetrical.

The preferred examples of the present invention will be given below.

The preferred examples of B include an oxyethylene, an oxypropylene, and an oxy(hydroxy) propylene, or the mixture thereof.

$R_1$ is preferably an alkyl, alkenyl or alkylaryl group, having 4 to 24 carbon atoms and more preferably a hexyl group, a dodecyl group, and isostearyl group, an oleyl group, a t-butylphenyl group, a 2,4-di-t-butylphenyl group, a 2,4-di-t-pentylphenyl group, a p-dodecylphenyl group, a m-pentadecaphenyl group, a t-octylphenyl group, a 2,4-dinonylphenyl group, an octylnaphthyl group, etc.

$R_2$, $R_3$, $R_6$, $R_7$, $R_8$, and $R_9$ are preferably a substituted or unsubstituted alkyl group having 1 to 20 carbon atoms such as methyl, ethyl, i-propyl, t-butyl, t-amyl, t-hexyl, t-octyl, nonyl, decyl, dodecyl, trichloromethyl, tribromomethyl, 1-phenylethyl, 2-phenyl-2-propyl, etc.; a substituted or unsubstituted aryl group such as phenyl group, p-chlorophenyl group, etc.; a substituted or unsubstituted alkoxy or aryloxy group that are represented by $-OR_{11}$ (wherein $R_{11}$ represents a substituted or unsubstituted alkyl or aryl group. The same shall apply hereinafter.); a halogen atom such as chlorine atom, bromine atom, etc.; an acryl group represented by $-COR_{11}$; an amide group represented by $-NR_{12}COR_{11}$ (wherein $R_{12}$ represents a hydrogen atom or an alkyl group having 1 to 20 carbon atoms. The same shall apply hereinafter.); a sulfonamide group represented by $-NR_{12}SO_2R_{11}$; a carbamoyl group represented by $$-CON\begin{matrix}R_{12}\\R_{12}\end{matrix};$$

or a sulfamoyl group represented by $$-SO_2N\begin{matrix}R_{12}\\R_{12}\end{matrix},$$

and $R_2$, $R_3$, $R_6$ and $R_9$ may also be a hydrogen atom. Of these, $R_6$ and $R_8$ are preferably an alkyl group or a halogen atom, and more preferably bulky tertiary alkyl group such as a t-butyl group, a t-amyl group, a t-octyl group, etc. $R_7$ and $R_9$ are more preferably a hydrogen atom. That is to say, the compound of general formula (III"), which can be synthesized from 2,4-disubstituted phenol, is most preferable.

$R_4$ and $R_5$ are preferably a hydrogen atom; a substituted or unsubstituted alkyl group such as methyl group, an ethyl group, an n-propyl group, an i-propyl group, an n-heptyl group, a 1-ethylamyl group, an n-undecyl group, a trichloromethyl group, a tribromomethyl group, etc.; a substituted or unsubstituted aryl group such as an α-furyl group, a phenyl group, a naphthyl group, a p-chlorophenyl group, a p-methoxyphenyl group, a m-nitrophenyl group, etc. Also, $R_4$ and $R_5$, $R_6$ and $R_7$, and $R_8$ and $R_9$ may form a substituted or unsubstituted ring when taken together, such as, for instance, a cyclohexyl ring. Of these, $R_4$ and $R_5$ are more preferably a hydrogen atom, an alkyl group having 1 to 8 carbon atoms, a phenyl group, and a furyl group. $n_1$, $n_2$, $n_3$ and $n_4$ are more preferably a number of 5 to 30. $n_3$ and $n_4$ may be the same or different.

These compounds are described, for example, in U.S. Pat. Nos. 2,982,651, 3,428,456, 3,457,076, 3,454,625, 3,552,972 and 3,655,387, Japanese patent publication No. 9610/76, Japanese patent application (OPI) Nos. 29715/78, 89626/79, 203435/83, and 208743/83, Hiroshi Horiguchi, *Shin Kaimen Kasseizai* (*New Surface Active Agents*), Published by Sankyo Co., Ltd. (1975), etc.

Specific examples of fluorine-free nonionic surface active agents are shown below.

$C_{11}H_{23}COO(CH_2CH_2O)_8H$ III-1

$C_{15}H_{31}COO(CH_2CH_2O)_{15}H$ III-2

$C_{17}H_{33}COO(CH_2CH_2O)_{15}H$ III-3

$C_8H_{17}O(CH_2CH_2O)_7H$ III-4

$C_{12}H_{25}O(CH_2CH_2O)_{10}H$ III-5

$C_{16}H_{33}O(CH_2CH_2O)_{12}H$ III-6

$C_{18}H_{35}O(CH_2CH_2O)_{16}H$ III-7

$C_{22}H_{45}O(CH_2CH_2O)_{25}H$ III-8

III-9

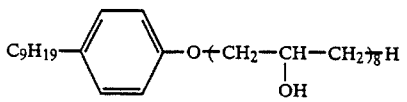

III-10

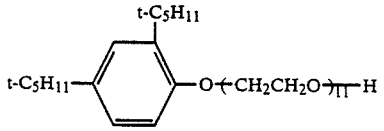

-continued
III-11
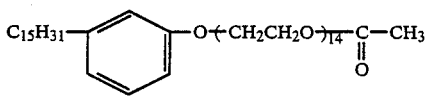
III-12
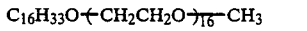
III-13
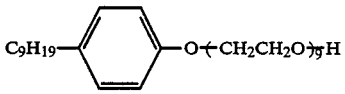
III-14
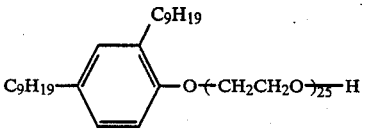
III-15
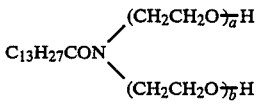
a + b = 15
III-16
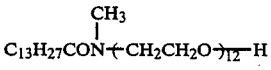
III-17
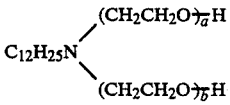
a + b = 20
III-18
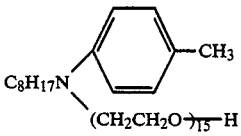
III-19
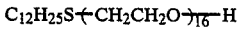
III-20
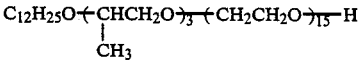
III-21
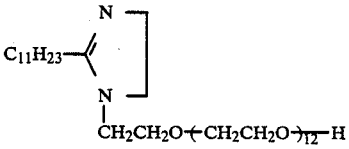
III-22
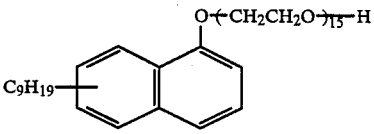
III-23
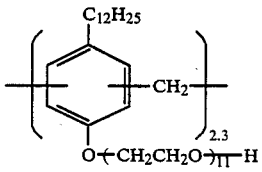
-continued
III-24
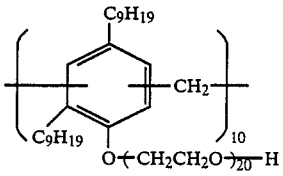
III-25
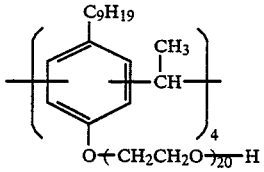
III-26
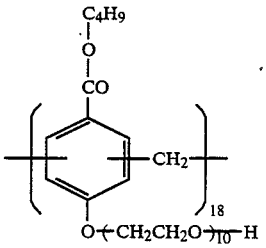
III-27
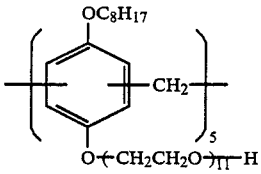
III-28
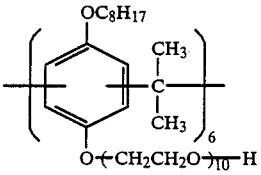
III-29
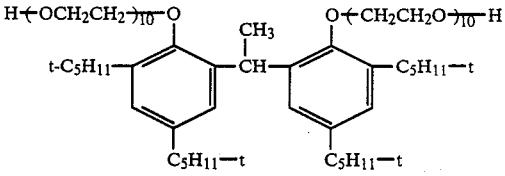
III-30
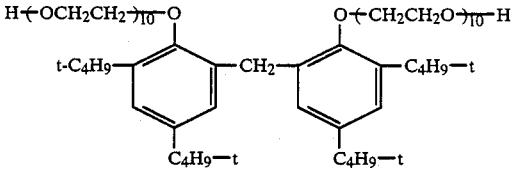
III-31
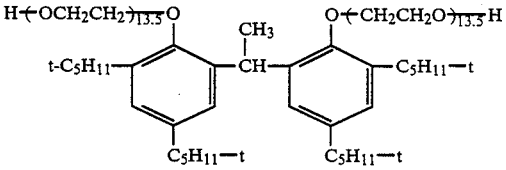

-continued

III-32

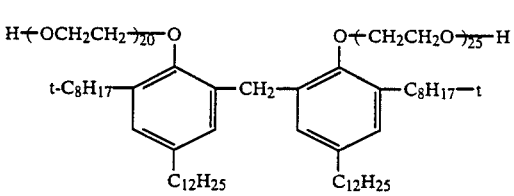

III-33

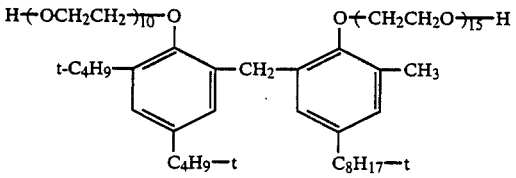

III-34

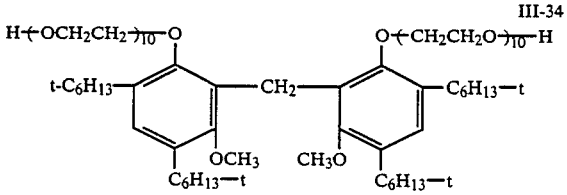

III-35

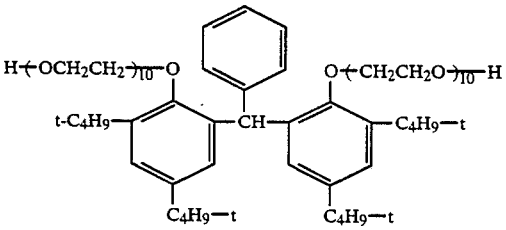

III-36

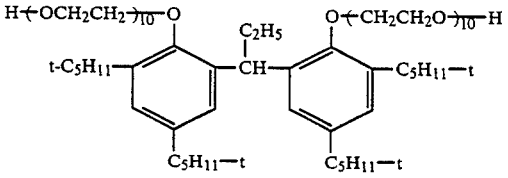

III-37

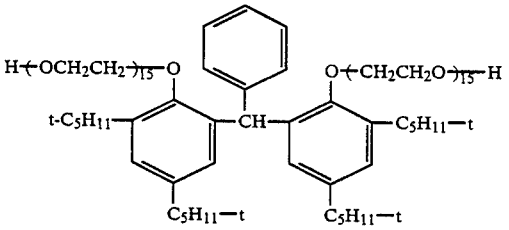

III-38

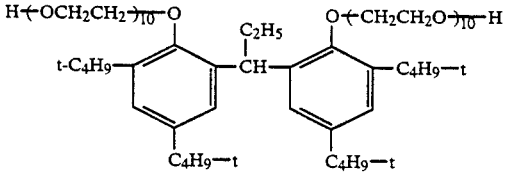

-continued

III-39

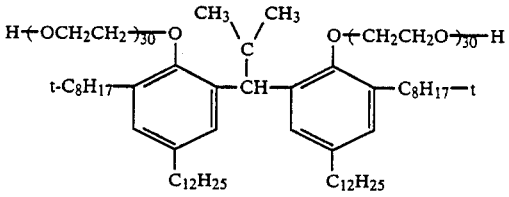

III-40

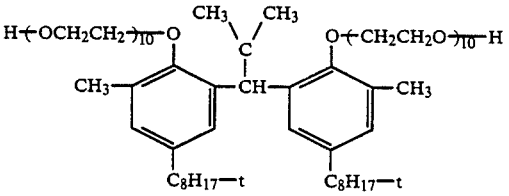

III-41

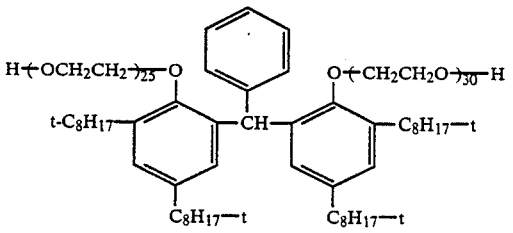

III-42

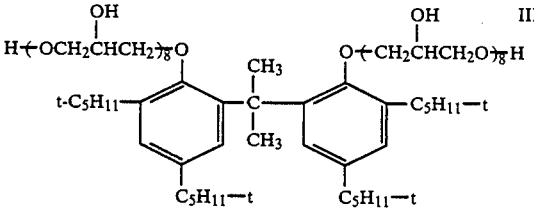

III-43

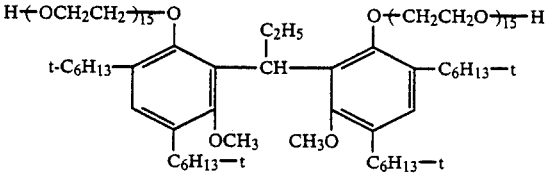

III-44

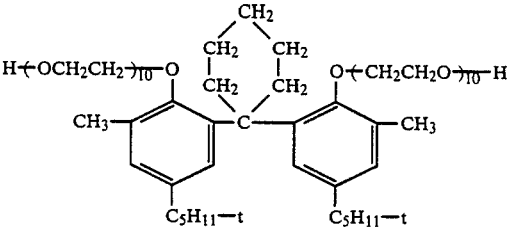

The fluorine-containing nonionic surface active agents, the fluorine-containing ionic surface active agents and the fluorine-free nonionic surface active agents of the present invention are added in at least one of the silver halide emulsion layer and another constituent layer of the photographic light-sensitive material. Preferred examples of such another constituent layer includes a hydrophillic colloid layer such as a surface protective layer, a backing layer, an interlayer, an undercoat layer, and an overcoat layer, etc. The surface active agents of the present invention are preferably added in an adjacent layer of the silver halide emulsion layer, more preferably added in a surface protective layer, a backing layer, an interlayer, an undercoat layer, or an overcoat layer of a protective or backing layer, and most preferably added in a surface protective layer, a backing layer, or an overcoat layer of a protective or backing layer. The surface active agents of three kinds may be added in the same or different layer, and are preferably added in the same layer.

When the surface protective layer or backing layer consists of two layers, these surface active agents may be added in either of the two layers. Alternatively, the surface protective layer may be overcoated with these surface active agents.

When the fluorine-containing nonionic surface active agent, fluorine-containing ionic surface active agent and the fluorine-free nonionic surface active agent of the present invention are applied to a photographic light-sensitive material, these surface active agents are first dissolved in water or an organic solvent such as methanol, isopropanol, and acetone, or a mixture thereof. The solution thus obtained is then added to a coating solution for the surface protective layer or backing layer. The coating solution is applied to the surface active layer or backing layer by a suitable process such as dip coat, air-knife coat, spray coat, and extrusion coat using a hopper described in U.S. Pat. No. 2,681,294. Preferably, two or more layers are simultaneously coated with the coating solution by a process as described in U.S. Pat. Nos. 3,508,947, 2,941,898 and 3,526,528. Alternatively, the layers are immersed in an antistatic solution. The protective layer is optionally further coated with an antistatic solution (optionally containing a binder) containing the fluorine-containing nonionic surface active agent, fluorine-containing ionic surface active agent and fluorine-free nonionic surface active agent of the present invention.

The amount of the fluorine-containing nonionic surface active agent and fluorine-containing ionic surface active agent to be used in the present invention is preferably 0.0001 to 2.0 g, more preferably 0.0005 to 0.3 g per 1 $m^2$ of the photographic light-sensitive material, respectively.

The amount of the fluorine-free nonionic surface active agents of the present invention to be used in the present invention is preferably 0.002 to 5 g, more preferably 0.01 to 0.5 g per 1 $m^2$ of the photographic light-sensitive material.

The weight ratio of the used amount of the fluorine-containing nonionic surface active agent to that of the fluorine-containing ionic surface active agent is preferably 1/100 to 100/1, more preferably 1/50 to 50/1.

The weight ratio of the used amount of the fluorine-containing surface active agent (total amount of the fluorine-containing nonionic surface active agent and the fluorine-containing ionic surface active agent) to that of the fluorine-free surface active agent is preferably 10/1 to 1/100.

It goes without saying that the above range depends on the type, composition, form or coating process of the photographic film base to be used.

The surface active agents of three kinds (the fluorine-containing nonionic, fluorine-containing ionic, and fluorine-free nonionic surface active agents) of the present invention each may be used in a mixture of two or more kinds thereof.

In order to obtain more preferably antistatic effects, another antistatic agent may be incorporated in the layer containing the fluorine-containing nonionic surface active agent, fluorine-containing ionic surface active agent and fluorine-free nonionic surface active agent of the present invention or another layer. Examples of such an antistatic agent include polymers described in U.S. Pat. Nos. 2,882,157, 2,972,535, 3,062,785, 3,262,807, 3,514,291, 3,615,531, 3,753,716, 3,938,999, 4,070,189, and 4,147,550, West German Pat. No. 2,800,466, and Japanese patent application (OPI) Nos. 91165/73, 94433/73, 46733/74, 54672/75, 94053/75, and 129520/77, surface active agents described in U.S. Pat. Nos. 2,982,651, 3,428,456, 3,457,076, 3,454,625, 3,552,972 and 3,655,387, metal oxides as described in U.S. Pat. Nos. 3,062,700, 3,245,833 and colloid silicas as described in U.S. Pat. No. 3,525,621, and so-called matting agents comprising bariumstrontium sulfate, polymethylmethacrylate, methylmethacrylate methacrylic acid copolymer, colloid silica or powdered silica.

Alternatively, polyol compounds as described in Japanese patent application (OPI) No. 89626/79, such as ethylene glycol, propylene glycol and 1,1,1-trimethylol propane may be incorporated in the layer containing the surface active agents of the present invention or another layer to attain more preferably antistatic effects.

Examples of the support which can be used for the present photographic light-sensitive material include films of polyolefins such as polyethylene, polystyrene, cellulose derivatives such as cellulose triacetate, and cellulose esters such as polyethylene terephthalate, sheets comprising baryta paper, synthetic paper or ordinary paper coated with these polymer films on the both sides thereof, and the like. A thickness of the support is preferably from 50 μm to 1 mm, and particularly preferably from 80 μm to 0.5 mm.

An anti-halation layer may be provided on the support to be used in the present invention. To this end, carbon black or various dyes such as an oxonol dye, an azo dye, an arylitene dye, a styryl dye, anthraquinone dye, a melocyanine dye, and a tri- (or di-)allyl methane dye can be used.

Examples of the light-sensitive material of the present invention include ordinary black-and-white silver halide photographic materials such as black-and-white light-sensitive material for photographing, black-and-white light-sensitive material for X-ray photographing and black-and-white light-sensitive material for printing, and ordinary multi-layer color light-sensitive materials such as color reversal film, color negative film, and color positive film. In particular, the silver halide photographic material of the present invention is effectively applied for high temperature rapid treatment or high sensitivity silver halide photographic materials.

The silver halide photographic materials of the present invention are briefly described hereinafter.

As the binder for the photographic layer, proteins such as gelatin and casein, cellulose compounds such as carboxy methyl cellulose and hydroxy ethyl cellulose, sugar derivatives such as agar, sodium alginate, and starch, and synthetic hydrophilic colloid such as polyvinyl alcohol, dextran, poly-N-vinyl pyrrolidone, polyacrylic acid copolymer, and polyacryl amide, or derivatives thereof and partial hydrolyzates thereof, may be used singly or in combination. Of these, gelatin, dextran and polyacryl amide, or derivatives thereof and partial hydrolyzates thereof are preferably used.

The term "gelatin" as used herein means so-called lime-treated gelatin, acid-treated gelatin or enzyme-treated gelatin.

The photographic constituent layer of the present invention may contain other known surface active agents, singly or in admixture. These surface active agents are generally used as coating aids but may be sometimes used for other purposes such as improvements in emulsification or dispersion, sensitization and other photographic properties, and reduction of electric generation property.

These surface active agents are classified into natural surface active agents such as saponin, nonionic surface active agents such as alkylene oxides, glycerins and glycidols, cationic surface active agents such as higher alkyl amines, quarternary ammonium salts, pyridine and other heterocyclic compounds, phosphonium, and sulfonium anionic surface active agents containing acidic groups such as carboxylic acid, sulfonic acid, phosphoric acid, sulfate, and phosphate, and amphoteric surface active agents such as amino acids, aminosulfonic acids, and sulfates or phosphates of amino alcohol.

Examples of these surface active agent compounds which may be used in the present invention are partially described in U.S. Pat. Nos. 2,271,623, 2,240,472, 2,288,226, 2,739,891, 3,068,101, 3,158,484, 3,201,253, 3,210,191, 3,294,540, 3,415,649, 3,442,413, 3,442,654, 3,475,174, 3,545,974, 3,666,478, and 3,507,660, British Pat. No. 1,198,450, Ryohei Oda et al, *Kaimen-Kasseizai no Gosei to sono Ouyou* (*Synthesis and Application of Surface Active Agents*), published by MAKI SHOTEN (1964), A. W. Perry, *Surface Active Agents,* published by Inter Science Publication Incorporated (1958) and J. P. Shisley, *Encyclopedia of Active Agents,* Vol. II, published by Chemical Publish Company (1964).

In the present invention, a lubricating compound such as modified silicone as described in U.S. Pat. Nos. 3,079,837, 3,080,317, 3,545,970, and 3,294,537, and Japanese patent application (OPI) No. 129520/77 may be incorporated in the photographic constituent layer.

In the photographic light-sensitive material of the present invention, the photographic constituent layer may contain a polymer latex as described in U.S. Pat. Nos. 3,411,911 and 3,411,912, and Japanese patent publication No. 5331/70 or a matting agent such as silica, strontium sulfate, barium sulfate, and polymethyl methacrylate.

In the photographic light-sensitive material of the present invention, the photographic constituent layer may contain an alkyl acrylate latex as described in U.S. Pat. Nos. 3,411,911 and 3,411,912 and Japanese patent publication No. 5331/70.

The silver halide grains to be contained in the photographic emulsion used in the photographic light-sensitive material of the present invention may be in the regular crystal form such as cube, octahedron, etc., or irregular crystal form such as spherical, tabular, etc., or in a composite form thereof. Alternatively, the silver halide may be tabular grains as described in *Research Disclosure,* Vol. 225, RD No. 22534, pp. 20–58 (Jan. 1983). Furthermore, it may be in the form of a mixture of various crystals.

The photographic emulsion to be used in the present invention may be a mixed emulsion of a light-sensitive halide silver emulsion and an internally fogged silver halide emulsion or a combination of these emulsions each contained in a separate layer as described in U.S. Pat. Nos. 2,996,382, 3,397,987, and 3,705,858. Herein, further, the combined use of mercapto compounds as described in Japanese patent application (OPI) No. 48832/86 is preferable in the points of restraint of fogging, improvement in storage stability, etc.

The photographic emulsion to be used in the present invention can be prepared by any one of processes described in P. Glafkides, *Chimie et Physique Photographique,* published by Paul Montel Co. (1967), G. F. Duffin, *Photographic Emulsion Chemistry,* published by The Focal Press (1966) and V. L. Zelikman et al, *Marking and Coating Photographic Emulsion,* published by The Focal Press (1964), etc.

The silver halide emulsion layer of the present invention, if necessary, may contain dyes. As the dyes, those as described, for example, in *Research Disclosure* Vol. 176, RD No. 17643, Section VIII can be used in the present invention. Also, in order to improve the color tone of the developed silver, magenta dyes as described in Japanese patent application No. 127663/85 (corresponding to U.S. Ser. No. 872,895, filed on June 11, 1986) may be used.

The type and preparation of silver halide to be used in the silver halide emulsion layer and surface protective layer of the photographic light-sensitive material of the present invention are not specifically limited. Furthermore, the chemical sensitization, antifoggant, stabilizer, hardening agent, plasticizer, lubricant, coating aid, matting agent, brightening agent, spectral sensitizing dye, dye, and color coupler for the silver halide material are not specifically limited. For example, reference can be made to *Research Disclosure,* Vol. 176, RD No. 17643, pp. 22–31 (Dec. 1978).

The present invention is further illustrated in the following examples, but the present invention should not be construed as being limited thereto.

EXAMPLE 1

Sample Nos. 1-1 to 1-10 were prepared by providing an emulsion layer and a protective layer to one side of a terephthalate film support having a thickness of about 175 μm in order and drying the coat. The composition of each layer is shown as follows:

| | | |
|---|---|---|
| Emulsion layer: (thickness: about 5 μm) | | |
| Binder | gelatin | 2.5 g/m$^2$ |
| Coated amount of silver | | 5 g/m$^2$ |
| Composition of silver halide: | AgI | 1.5 mol % |
| | AgBr | 98.5 mol % |
| Fog restrainer | 1-phenyl-5-mercapto-tetrazole | 0.5 g/100 g-Ag |
| Protective layer: (thickness: about 1 μm) | | |
| Binder | gelatin | 1.7 g/m$^2$ |
| Coating agent | N—oleoyl-N—methyl taurine sodium salt | 7 mg/m$^2$ |
| Hardening agent | 2,4-dichloro-6-hydroxy-1,3,5-triazine sodium salt | 0.4 g/100 g-gelatin |

Sample No. 1-1 consists of the above composition alone. Sample Nos, 1-2 to 1-5 comprise the above composition and their protective layers further contain the compounds of the present invention shown in Table 1. Sample Nos. 1-6 to 1-10 are comparative examples.

Each of these unexposed samples were subjected to humidity control at a temperature of 25° C. and a humidity of 10% RH(Relative Humidity) for 2 hours. Each of these samples was then subjected to friction by a rubber roller and a nylon roller in a dark room having the same air condition to observe static marks against various elements. Each of these samples was subjected to development by a developing agent shown below, fixing, and washing to observe generation of static mark.

| Developer composition | |
|---|---|
| Warm water | 800 ml |
| Sodium tetrapolyphosphate | 2.0 g |
| Sodium sulfite anhydride | 50 g |
| Hydroquinone | 10 g |
| Sodium carbonate (monohydrate) | 40 g |
| 1-Phenyl-3-pyrazolidone | 0.3 g |
| Potassium bromide | 2.0 g |
| Water to make | 1000 ml (pH 10.2) |

The results of the antistatic properties of these samples are shown in Table 1.

TABLE 1

| Sample No. | Fluorine-containing nonionic surface active agent (added amount) | Fluorine-containing ionic surface active agent (added amount) | Fluorine-free nonionic surface active agent (added amount) | Generation of static marks Rubber | Nylon | Coating property (Number of repelling portions (i.e., repelling) Per 250 $m^2$) |
|---|---|---|---|---|---|---|
| 1-1 (control) | None | None | None | D | D | 0 |
| 1-2 (present invention) | Compound I-1 (5 $mg/m^2$) | Compound II-1 (5 $mg/m^2$) | Compound III-5 (35 $mg/m^2$) | A | A | 0 |
| 1-3 (present invention) | Compound I-5 (5 $mg/m^2$) | Compound II-7 (2.5 $mg/m^2$) | Compound III-10 (28 $mg/m^2$) | A | A | 0 |
| 1-4 (present invention) | Compound I-7 (3 $mg/m^2$) | Compound II-7 (2 $mg/m^2$) | Compound III-37 (36 $mg/m^2$) | A | A | 0 |
| 1-5 (present invention) | Compound I-9 (6 $mg/m^2$) | Compound II-21 (3 $mg/m^2$) | Compound III-23 (35 $mg/m^2$) | A | A | 0 |
| 1-6 (comparison) | Compound I-1 (5 $mg/m^2$) | None | None | D | C | 0 |
| 1-7 (comparison) | Compound I-1 (5 $mg/m^2$) | Compound II-1 (5 $mg/m^2$) | None | B | B | 5 |
| 1-8 (comparison) | Compound I-1 (5 $mg/m^2$) | None | None | B | D | 2 |
| 1-9 (comparison) | Compound I-1 (5 $mg/m^2$) | None | Compound III-5 (35 $mg/m^2$) | B | B | 126 |
| 1-10 (comparison) | None | Compound II-21 (3 $mg/m^2$) | Compound III-37 (36 $mg/m^2$) | C | A | 0 |

Note:
The rating of Generation of static marks was as follows;
A—No static marks were observed with naked eye.
B—A few static marks were observed with naked eye.
C—Significant static marks were observed with naked eye.
D—Static marks were observed almost all over the surface with naked eye.
A and B are suitable for practical use.

As apparent from Table 1, Sample Nos. 1-2 to 1-5 which had been rendered antistatic by the combined use of the fluorine-containing nonionic, fluorine-containing ionic, and fluorine-free nonionic surface active agents of the present invention have an excellent antistatic effect that they show little generation of static mark against a roller made of two different elements (i.e., rubber and nylon) under a humidity condition of 10% RH. These samples are also excellent in coating properties (e.g., generation of repelling). On the other hand, the control sample is seriously poor in antistatic property, and in the case of Sample Nos. 1-6 to 1-10 for comparison, antistatic mark property and coating property (e.g., generation of repelling) cannot be simultaneously improved against both the two materials, i.e., rubber and nylon. For example, if the antistatic mark property against rubber roller is improved, the antistatic mark property against nylon roller is poor. On the contrary, if the antistatic mark property against nylon roller is improved, the antistatic mark property against rubber roller is so poor or even if the antistatic mark property against both the two elements may be improved in some degree, the repelling in coating becomes large. This shows that the combined use of the surface active agents of the present invention has the most excellent antistatic property.

These control and comparative samples are also seriously poor in coating property (e.g., generation of repelling) as compared with the present invention.

EXAMPLE 2

Sample Nos. 2-1 to 2-9 were prepared by providing a cellulose triacetate support, an anti-halation layer, a red-sensitive layer, an interlayer, a green-sensitive layer, a yellow filter layer, a blue-sensitive layer and a protective layer in order. The preparation of these samples was accomplished by conventional coating and drying processes. The composition of the above layers were shown as follows:

| | | |
|---|---|---|
| Anti-halation layer | | |
| Binder | gelatin | 4.4 $g/m^2$ |
| Hardening agent | 1,3-bis(vinyl sulfonyl)-propanol-2 | 1.2 g/100 g-binder |
| Coating aid | Sodium dodecylbenzenesulfonate | 4 $mg/m^2$ |
| Anti-halation component | black colloidal silver | 0.4 $g/m^2$ |
| Red-sensitive layer | | |
| Binder | gelatin | 7 $g/m^2$ |
| Hardening agent | 1,3-bis(vinyl sulfonyl)-propanol-2 | 1.2 g/100 g-binder |
| Coating aid | Sodium dodecylbenzenesulfonate | 10 $mg/m^2$ |
| Coated amount of silver | | 3.1 $g/m^2$ |
| Silver halide compostion | AgI<br>AgBr | 2 mol %<br>98 mol % |
| Fog restrainer | 4-hydroxy-6-methyl-1,3,3a,7-tetrazaindene | 0.98 g/100 g-Ag |

-continued

| | | |
|---|---|---|
| Color former | 1-hydroxy-4-(2-acetyl phenyl)azo-N—[4-(2,4-di-tert-amylphenoxy)butyl]-2-naphthoamide | 38 g/100 g-Ag |
| Sensitizing dye | Anhydro-5,5'-dichloro-9-ethyl-3,3'-di(3-sulfo-propyl)thiacarbocyanine-hydroxide pyridinium salt | 0.3 g/100 g-Ag |
| Interlayer | | |
| Binder | gelatin | 2.6 g/m$^2$ |
| Hardening agent | 1,3-bis(vinyl sulfonyl)-propanol-2 | 1.2 g/100 g-binder |
| Coating aid | Sodium dodecylbenzenesul-fonate | 12 mg/m$^2$ |
| Green-sensitive layer | | |
| Binder | gelatin | 6.4 g/m$^2$ |
| Hardening agent | 1,3-bis(vinyl sulfonyl)-propanol-2 | 1.2 g/100 g-binder |
| Coating aid | Sodium dodecylbenzenesul-fonate | 9 mg/m$^2$ |
| Coated amount of silver | | 2.2 g/m$^2$ |
| Silver halide composition | AgI<br>AgBr | 3.3 mol %<br>96.7 mol % |
| Stabilizer | 4-hydroxy-6-methyl-1,3,3a,7-tetrazaindene | 0.6 g/100 g-Ag |
| Color former | 1-(2,4,6-trichlorophenyl)-3-[3-(2,4-di-tert-amylphenoxy)-acetoamide]benzamide-4-(4-methoxy phenyl)azo-5-pyrazolone | 3.7 g/100 g-Ag |
| Sensitizing dye | Anhydro-5,5'-diphenyl-9-ethyl-3,3'-di(2-sulfo-ethyl)oxacarbocyanine-hydroxide pyridinium salt | 0.3 g/100 g-Ag |
| Yellow filter layer | | |
| Binder | gelatin | 2.3 g/m$^2$ |
| Filter component | Yellow coloidal silver | 0.7 g/m$^2$ |
| Hardening agent | 1,3-bis(vinyl sulfonyl)-propanol-2 | 1.2 g/100 g-binder |
| Surface active agent | Triton X-200 (made by Rohm & Haas Co.) | 100 mg/m$^2$ |
| Blue-sensitive layer | | |
| Binder | gelatin | 7 g/m$^2$ |
| hardening agent | 1,3-bis(vinyl sulfonyl)-propanol-2 | 1.2 g/100 g-binder |
| Coating aid | Sodium dodecylbenzenesul-fonate | 8 mg/m$^2$ |

-continued

| | | |
|---|---|---|
| Coated amount of silver | | 2.2 g/m$^2$ |
| Silver halide composition | AgI<br>AgBr | 3.3 mol %<br>96.7 mol % |
| Stabilizer | 4-hydroxy-6-methyl-1,3,3a,7-tetrazaindene | 0.4 g/100 g-Ag |
| Color former | 2'-chloro-5'-[2-(2,4-di-tert-amylphenoxy)butylaminde]-α-(5,5'-dimethyl-2,4-dioxo-3-oxazolidinyl)-α-(4-methoxy-benzoyl)acetoanilide | 45 g/100 g-Ag |
| Protective layer | | |
| Binder | gelatin | 2 g/m$^2$ |
| Hardening agent | 1,3-bis(vinyl sulfonyl)-propanol-2 | 1.2 g/100 g-binder |
| Coating aid | Triton X-200 (made by Rohm & Haas Co.) | 150 mg/m$^2$ |
| Matting agent | Copolymer of polymethyl methacrylate and polymeth-acrylate (copolymerization ratio: 6/4; average particle diameter: 2.5 μm) | 100 mg/m$^2$ |

Sample No. 2-1 consists of the above composition alone. In Sample Nos. 2-2 to 2-5, the protective layers further contain the compounds of the present invention shown in Table 2. Sample Nos. 2-6 to 2-9 are comparative examples. These samples were subjected to the same test as used in Example 1 except in that these samples were subjected to conventional color development. The tests contain the antistatic property with the passage of time. The results are shown in Table 2.

TABLE 2

| Sample No. | Fluorine-containing nonionic surface active agent (added amount) | Fluorine-containing ionic surface active agent (added amount) | Fluorine-free nonionic surface active agent (added amount) | Generation of static marks immediately after coating | | Generation of static marks after storage for a week at 40° C. and 70% RH | |
|---|---|---|---|---|---|---|---|
| | | | | Rubber | Nylon | Rubber | Nylon |
| 2-1 (control) | None | None | None | D | D | D | D |
| 2-2 (present | Compound I-3 (10 mg/m$^2$) | Compound II-7 (10 mg/m$^2$) | Compound III-6 (30 mg/m$^2$) | A | A | A | A |
| 2-3 (present invention) | Compound I-6 (13.5 mg/m$^2$) | Compound II-13 (5 mg/m$^2$) | Compound III-31 (40 mg/m$^2$) | B | A | A | B |
| 2-4 (present invention) | Compound I-7 (7.5 mg/m$^2$) | Compound II-21 (9 mg/m$^2$) | Compound III-35 (35 mg/m$^2$) | A | B | A | A |
| 2-5 (present invention) | Compound I-8 (10 mg/m$^2$) | Compound II-1 (4 mg/m$^2$) | Compound III-6 (30 mg/m$^2$) | A | A | B | A |
| 2-6 (comparison) | Compound I-3 (10 mg/m$^2$) | None | None | C | D | D | D |
| 2-7 (comparison) | Compound I-3 (10 mg/m$^2$) | Compound II-7 (10 mg/m$^2$) | None | A | D | B | C |
| 2-8 (comparison) | None | Compound II-1 (9 mg/m$^2$) | Compound III-6 (30 mg/m$^2$) | B | A | C | D |
| 2-9 (comparison) | Compound I-3 (10 mg/m$^2$) | None | Compound III-6 (30 mg/m$^2$) | C | B | D | C |

As apparent from Table 2, the film samples which comprise the fluorine-containing nonionic, fluorine-containing ionic and fluorine-free nonionic surface active agents of the present invention in combination show excellent antistatic properties that they generate little or no static mark against both the two different elements (i.e., rubber and nylon). These film samples keep excellent antistatic properties even under a forced storage condition. On the other hand, the film samples using the conventional surface active agents which comprise one or two kinds of these three surface active agents have poor antistatic properties that they cannot be prevented from generating static marks against both the two elements. These film samples are also disadvantageous in that their antistatic properties are subject to a big change after a forced storage. This shows that the combined use of the present surface active agents shows significantly superiority over the prior art photographic light-sensitive materials.

These samples were exposed to light in accordance with JIS K-7614 (1986) and then subjected to a conventional color development. As a result, there were shown no adverse effects on the photographic properties.

Thus, it was confirmed that the combined use of the surface active agents of the present invention gives no adverse effects on the photographic properties.

EXAMPLE 3

(1) Preparation of silver halide emulsion for upper emulsion layer

Spherical grains of silver indobromide (silver iodide: 1.5 mol %) were formed by a double jet process in the presence of ammonia (average grain size: 1.0 μm). The silver iodobromide was then chemically sensitized by a chloroaurate and sodium thiosulfate.

An anhydro-5,5'-dichloro-9-ethyl-3,3'-di(3-sulfopropyl)oxacarbocyanine hydroxide sodium salt (5 mg/m$^2$) as a spectral sensitizing dye, potassium iodide, a polyacrylamide having a weight average molecular weight (MW) of 60,000, an antifoggant, a coating aid, and the like were added to the silver iodobromide thus sensitized to obtain a coating solution for upper emulsion layer. The weight ratio of silver to gelatin is 1.30. The weight ratio of polyacrylamide to gelatin is 0.15.

(2) Preparation of emulsion of tabular grains of silver halide

Potassium bromide, thioether ($HO(CH_2)_2S(CH_2)_2S(CH_2)_2OH$), and gelatin were mixed with each other to obtain a solution. A mixed solution of a silver nitrate solution, potassium iodide and potassium bromide was then added to the above solution maintained at a temperature of 70° C. while stirring by a double jet process.

After the addition was completed, the mixture was allowed to cool to a temperature of 35° C. After soluble salts were removed by the sedimentation process, the mixture was again heated to a temperature of 40° C. 60 g of gelatin was further added to the mixture to obtain a solution with a pH of 6.8.

The resulting tabular grains of silver halide had an average diameter of 1.10 μm and an average thickness of 0.15 μm. The ratio of average diameter to average thickness was 7.33. The content of silver iodide was 3 mol %. The pAg at a temperature of 40° C. was 8.95.

The emulsion was then subjected to chemical sensitization (gold-sulfur sensitization). An anhydro-5,5'-dichloro-9-ethyl-3,3'-di(3-sulfopropyl)oxacarbocyaninehydroxide sodium salt as a sensitizing dye and potassium iodide were added to the emulsion thus sensitized in amounts of 500 mg and 200 mg per 1 mol of silver, respectively, to conduct green-sensitization. Furthermore, 4-hydroxy-6-methyl-1,3,3a,7-tetrazaindene and 2,6-bis(hydroxyamino)-4-diethylamino-1,3,5-triazine (3 mg/m$^2$ in total) as a stabilizer was added to the emulsion.

(3) Preparation of coating solution for surface protective layer

A 10 wt % aqueous solution of gelatin containing sodium polystyrenesulfonate, a polymethyl methacrylate particle (average particle size: 3.6 μm) as a matting agent, a 4-(p-nonylphenoxy)butanesulfonic acid sodium salt (added amount: 10 mg/m$^2$), and a 1,2,4-dichloro-6-hydroxy-s-triazine sodium salt described in Japanese patent application (OPI) No. 203435/83 (Compound Example) was prepared to obtain a coating solution for surface protective layer (for control) (Sample No. 3-1).

Sample Nos. 3-2 to 3-5 were prepared by incorporating the compounds of the present invention in the surface protective layers. Sample Nos. 3-6 to 3-7 were comparative samples.

(4) Preparation of photographic light-sensitive material

An emulsion layer containing tabular grains of silver halide, an upper emulsion layer and a surface protective layer were provided on an undercoated polyethylene terephthalate film support having a thickness of 180 μm in order by simultaneous extrusion coating process and then dried.

The three layers described above were provided on the opposite side of the support in the same order and in the same manner as described above to prepare photographic materials 3-1 to 3-7.

The amount of silver coated on one side of the support was controlled by adjusting the silver content of the emulsion layer of tabular grains of silver halide and the upper emulsion layer in such a manner that $D_{max}$ reaches 2.0. The amount of gelatin coated on the surface protective layer was 1.1 g/m$^2$.

These unexposed samples were then subjected to humidity control at a temperature of 25° C. and 10% RH for 2 hours. These samples were further subjected to friction by a rubber roller and a nylon roller in a dark room with the same air condition to observe the generation of static marks against both the two elements (i.e., rubber and nylon). These samples were then subjected to an automatic development comprising development (developer: RD-III, produced by FUJI PHOTO FILM CO., LTD.), fixing, and washing to observe the generation of static marks.

Further, after these samples had been subjected to humidity control at a temperature of 25° C. and 75% RH for 2 hours, air was removed under pressure (20 mm Hg lower than the atmospheric pressure), and these samples air-tightly sealed into a packing bag was allowed to stand for one week at 25° C.

Furthermore, the generation of static marks was evaluated in the same air condition as described above by means of a conveyor which is widely used in the market (AOT-S film changer equipped with PDA, produced by Simens-Elema Co.).

The results are shown in Table 3.

TABLE 3

| Sample No. | Fluorine-containing nonionic surface active agent (added amount) | Fluorine-containing ionic surface active agent (added amount) | Fluorine-free nonionic surface active agent (added amount) | Generation of static marks | | Generation of static marks by conveyor in practical use |
|---|---|---|---|---|---|---|
| | | | | Rubber | Nylon | |
| 3-1 (control) | — | — | — | D | D | D |
| 3-2 (present | Compound I-3 (5 mg/m$^2$) | Compound II-1 (1 mg/m$^2$) | Compound III-6 (35 mg/m$^2$) | A | B | B |

TABLE 3-continued

| Sample No. | Fluorine-containing nonionic surface active agent (added amount) | Fluorine-containing ionic surface active agent (added amount) | Fluorine-free nonionic surface active agent (added amount) | Generation of static marks Rubber | Generation of static marks Nylon | Generation of static marks by conveyor in practical use |
|---|---|---|---|---|---|---|
| invention) | | | | | | |
| 3-3 (present invention) | Compound I-4 (3 mg/m$^2$) | Compound II-7 (3 mg/m$^2$) | Compound III-31 (40 mg/m$^2$) | A | A | A |
| 3-4 (present invention) | Compound I-7 (7 mg/m$^2$) | Compound II-10 (5 mg/m$^2$) | Compound III-22 (30 mg/m$^2$) | B | A | B |
| 3-5 (present invention) | Compound I-11 (5 mg/m$^2$) | Compound II-21 (5 mg/m$^2$) | Compound III-31 (30 mg/m$^2$) | A | B | A |
| 3-6 (comparison) | None | Compound II-1 (1 mg/m$^2$) | Compound III-31 (30 mg/m$^2$) | B | D | D |
| 3-7 (comparison) | Compound I-3 (10 mg/m$^2$) | None | Compound III-31 (30 mg/m$^2$) | D | D | D |

As apparent from Table 3, the photographic light-sensitive material using the fluorine-containing non-ionic, fluorine-containing ionic, and fluorine-free non-ionic surface active agents of the present invention in combination show little or no static marks against the two different elements (rubber and nylon), further have excellent antistatic properties against elements. Furthermore, the present photographic materials occur no static marks upon the practical test using a practical use conveyor after passage of time. This means that the effect of the present invention is excellent.

On the other hand, the comparative samples (Sample Nos. 6 and 7) find difficult to constantly satisfy antistatic properties against various elements. These comparative samples occur static marks also upon the practical test. The superiority of the present invention upon antistatic properties is worthy of special mention.

EXAMPLE 4

(1) Preparation of light-sensitive silver halide emulsion

A silver iodobromide emulsion (I=4.0 mol %) comprising thick tabular grains having an average grain size of 1.0 μm was prepared from silver nitrate, potassium bromide and potassium iodide by the conventional ammonia process while the halogen ion concentration in a container containing a halogen and gelatin was maintained relatively high. The silver iodobromide emulsion thus prepared was then chemically sensitized by a chloroaurate and sodium thiosulfate to obtain a light-sensitive silver halide emulsion A.

(2) Preparation of internally fogged silver halide emulsion

An internally sensitive silver chlorobromide emulsion having an average grain size of 0.2 μm was prepared in the same manner as described in Example I of U.S. Pat. No. 2,592,250. The emulsion was then irradiated with light so that the inside thereof was fogged. 5-Alkylamide-2-mer-captobenzimidazole (3 mg/m$^2$) was then added as an antifoggant to the emulsion thus fogged to obtain an emulsion B.

(3) Preparation of coated samples

Samples were prepared by mixing the emulsion A and the emulsion B in such a manner that their molar ratio of Ag reached 4/1. 4-Hydroxy-6-methyl-1,3,3a,7-tetrazaindene (2 mg/m$^2$) was added to the emulsion layer as a stabilizer. The total amount of binder in the emulsion layer was 2.5 g/m$^2$ (per one side). About 20 wt % of the binder was polymer (polyacrylamide.dextran). A silver chlorobromide emulsion (Br concentration: 30 wt % or less) having a grain size of 0.2 μm, a surface active agent of the present invention as shown in Table 4 as an antistatic material, p-t-octylphenoxyethoxyethoxyethane sodium sulfonate (10 mg/m$^2$) as a coating agent, polymethylmethacrylate (PMMA) as a matting agent, and Snowtex (100 mg/m$^2$) as a film improving agent were added to the surface protective layer. As color tone improving agents there were added to Sample Nos. 4-3 and 4-8, an emulsified dispersion of a dye (prepared from 10 g of a dye of the structural formula shown below, 10 g of trihexylphosphate, 50 ml of ethyl acetate, 0.5 g of sodium dodecylbenzenesulfonate, and 100 ml of 15 wt % gelatin).

Dye: G—CH—CH=CH—G wherein G represents;

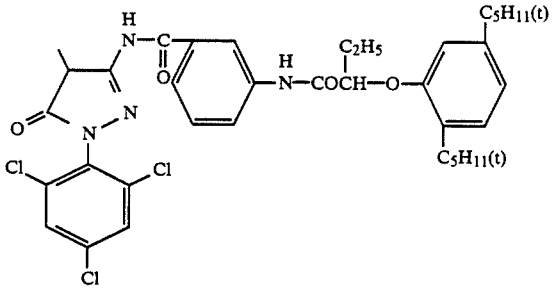

The total amount of the binder in the protective layer was about 1.5 g/m$^2$. About 20 wt % of the binder was a polymer.

These emulsion and surface protective layers thus prepared were provided on a polyethylene terephthalate support together with a vinylsulfonic hardening agent. The coat thus obtained was dried to obtain Sample Nos. 4-1 to 4-8.

Generation of static marks was evaluated with both the sample itself and the sample which was subjected to humidity control at a temperature of 25° C. and 75% RH, and, after having been put between interleaves which were also subjected to humidity control under the same conditions and air-tightly sealed into a packing bag under reduced pressure (20 mm Hg lower than the atmospheric pressure), was allowed to stand for one week at 25° C.

Further, these samples were also examined and evaluated for stain defect upon treatment in the following manner:

- The coated samples were cut into pieces of 30.5 cm×25.4 cm. These pieces were then uniformly exposed to light in such a manner that the optical density after development reached 1.3. 100 Sheets of the sheet samples thus light-exposed were continuously subjected to development by means of an automatic developing machine RU produced by FUJI PHOTO FILM CO., LTD. (developer: Fuji Photo Film RD-III; fixing solution: Fuji Photo FIlm Fuji-F; and washing bath). The degree of stain upon treatment was evaluated by counting the number of spot-like poor desilvered portions developed on the last sheet sample. The results were shown in Table 4.

TABLE 4

| Sample No. | Fluorine-containing nonionic surface active agent (added amount) | Fluorine-containing ionic surface active agent (added amount) | Fluorine-free nonionic surface active agent (added amount) | Generation of static marks Rubber | Generation of static marks Nylon | Generation of static marks after passage of time while being put between the interleaves | Stain upon treatment (Number of stains) |
|---|---|---|---|---|---|---|---|
| 4-1 (control) | None | None | None | D | D | D | 0 |
| 4-2 (present invention) | Compound I-7 (3.5 mg/m$^2$) | Compound II-7 (1.5 mg/m$^2$) | Compound III-31 (28 mg/m$^2$) | A | A | A | 0 |
| 4-3 (present invention) | Compound I-4 (2 mg/m$^2$) | Compound II-4 (7.5 mg/m$^2$) | Compound III-6 (30 mg/m$^2$) | B | A | B | 0 |
| 4-4 (present invention) | Compound I-10 (2 mg/m$^2$) | Compound II-13 (8 mg/m$^2$) | Compound III-23 (25 mg/m$^2$) | A | A | B | 1 |
| 4-5 (present invention) | Compound I-14 (5 mg/m$^2$) | Compound II-21 (3 mg/m$^2$) | Compound III-10 (30 mg/m$^2$) | A | B | B | 2 |
| 4-6 (comparison) | Compound I-7 (3.5 mg/m$^2$) | None | Compound III-31 (28 mg/m$^2$) | B | A | C | 253 |
| 4-7 (comparison) | Compound I-7 (3.5 mg/m$^2$) | Compound II-7 (1.5 m/m$^2$) | None | C | B | D | 0 |
| 4-8 (comparison) | None | Compound II-7 (1.5 mg/m$^2$) | Compound III-31 (28 mg/m$^2$) | B | A | D | 0 |

As apparent from Table 4, Sample Nos. 4-2 to 4-5, which use the fluorine-containing nonionic, fluorine-containing ionic, and fluorine-free nonionic surface active agents of the present invention in combination, have significantly improved anti-static mark properties as compared with the control sample (Sample No. 4-1).

Contrary to the above, in the case of Sample No. 4-6 using no fluorine-containing ionic surface active agent, the generation of static marks is somewhat good, but the degree of stain upon treatment is extremely bad, and also in the case where either the fluorine-containing nonionic surface active agent or the fluorine-free nonionic surface active agent is not used (Sample Nos. 4-7 and 4-8), the generation of static marks, especially the generation after allowing to stand while being put between the interleaves is remarkably bad.

As apparent from the above description, the present invention is excellent not only in antistatic properties but also in antistain properties.

While the invention has been described in detail and with reference to specific embodiments thereof, it will be apparent to one skilled in the art that various changes and modifications can be made therein without departing form the spirit and scope thereof.

What is claimed is:

1. A silver halide photographic material comprising a support having thereon at least one silver halide emulsion layer and another constituent layer selected from the group consisting of a surface protective layer, a backing layer, an interlayer, and undercoat layer and an overcoat layer, wherein at least one of said least one silver halide emulsion layer and another constituent layer contains a surface active effective amount of:

(A) a fluorine-containing nonionic surface active agent, (B) a fluorine-containing ionic surface active agent, and (C) a fluorine-free nonionic surface active agent, wherein the surface active agents can be added to the same or different layers, wherein said fluorine-containing nonionic surface active agent (A) is a compound represented by formula (I):

$$Rf\text{-}(A)_a\text{-}(\overset{R_1}{\overset{|}{N}})_n\text{-}(B)_b\text{-}(D)_d \quad (I)$$

wherein Rf represents a perfluoroalkyl, perfluoroaryl, or perfluoroalkenyl group, having 4 to 20 carbon atoms; $R_1$ represents a hydrogen atom, or a substituted or unsubstituted alkyl, or alkenyl group; A represents —Co—, —COO—, —SO—, —$SO_2$—, or —OCO—, B represents a substituted or unsubstituted alkylene, aralkylene, or arylene group; D represents a substituted or unsubstituted oxyalkylene group; a and n each represents 0 or 1; b represents, 0, 1, or 2; and d represents 2 to 50, wherein said fluorine-containing ionic surface active agent (B) is a compound represented by formula (II);

$$Rf\text{-}(A)_a\text{-}(\overset{R_1}{\overset{|}{N}})_n\text{-}(B)_b\text{-}(E)_e \quad (II)$$

wherein Rf represents a perfluoroalkyl, perfluoroaryl, or perfluoroalkenyl group, having 4 to 20 carbon atoms; $R_1$ represents a hydrogen atom, or a substituted or unsubstituted alkyl, or alkenyl group; A represents —CO—, —COO—, —SO—, —$SO_2$—, or —OCO—; B represents a substituted or unsubstituted alkylene, aralkylene, or arylene group; E represents an ionic hydrophilic group; a and n each represents 0 or 1; b represents 0, 1, or 2; and e represents 1 or 2.

wherein said fluorine-free surface active agent (C) is a compound represented by formula (III), (III'), or (III''):

$$R_1-A\text{-}(B)_{n1}-R \quad \text{(III)}$$

(III')

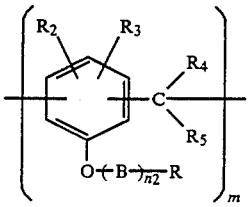

(III'')

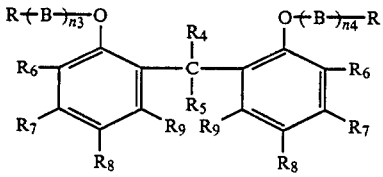

wherein R represents a hydrogen atom, an alkyl group having 1 to 4 carbon atoms or an alkylcarbonyl group having 1 to 5 carbon atoms; $R_1$ represents a substituted or unsubstituted alkyl, alkenyl, or aryl group, having 1 to 30 carbon atoms; A represents —O—, —S—, —COO—, $$-\underset{|}{N}-R_{10},\ -CO-\underset{|}{N}-R_{10},\ \text{or}\ -SO_2\underset{|}{N}-R_{10}$$

(wherein $R_{10}$ represents a hydrogen atom, or a substituted or unsubstituted alkyl group); B represents an oxyalkylene group having 8 or less carbon atoms; $R_2$, $R_3$, $R_7$, and $R_9$ each represents a hydrogen atom, or a substituted or unsubstituted alkyl, aryl, alkoxy, or aryloxy group, a halogen atom, an acyl group, an amide group, a sulfonamide group, a carbamoyl group, or a sulfamoyl group; $R_6$ and $R_8$ each represents a substituted or unsubstituted alkyl, aryl, alkoxy, or aryloxy group, a halogen atom, an acyl group, an amide group, a sulfonamide group, a carbamoyl group, or a sulfamoyl group; $R_4$ and $R_5$ each represents a hydrogen atom, a substituted or unsubstituted alkyl or aryl group; $n_1$, $n_2$, $n_3$, and $n_4$ each represents an average degree of polymerization of the oxyalkylene group, which is a number of 2 to 50; and m represents the average degree of polymerization, which is a number of 2 to 50, wherein the amount of the fluorine-containing nonionic surface active agent (A) is 0.0001 to 0.2 g per 1 $m^2$ of the photographic light-sensitive material, wherein the amount of the fluorine-containing ionic surface active agent (B) is 0.0001 to 0.05 g per 1 $m^2$ of the photographic light-sensitive material, wherein the amount of the fluorine-free nonionic surface active agent (C) is 0.0002 to 0.5 g per 1 $m^2$ of the photographic light-sensitive material, wherein the weight ratio of the amount of the fluorine-containing nonionic surface active (A) agent to that of the fluorine-containing ionic surface active agent (B) is from 1/100 to 100/1 and wherein the weight ratio of the total amount of fluorine-containing surface active agents (A) and (B) to that of the fluorine-free ionic surface active agent (C) is from 10/1 to 1/100.

2. A silver halide photographic material as claimed in claim 1, wherein said fluorine-containing nonionic surface active agent has a perfluoroalkyl, perfluoroalkeny, or perfluoroaryl group, having 6 to 14 carbon atoms and a substituted or unsubstituted polyoxyethylene group as a nonionic group.

3. A silver halide photographic material as claimed in claim 1, wherein said fluorine-containing ionic surface active agent has a perfluoroalkyl, perfluoroalkenyl, or perfluoroaryl group, having 6 to 14 carbon atoms.

4. A silver halide photographic material as claimed in claim 1, wherein the fluorine-containing nonionic surface agent, the fluorine-containing ionic surface active agent and the fluorine-free surface active agent are contained in a surface active layer, a backing layer, an interlayer, an undercoat layer, or a overcoat layer of a protective or backing layer.

5. A silver halide photographic material as claimed in claim 4, wherein the fluorine-containing nonionic surface active agent, the fluorine-containing ionic surface active agent and the fluorine-free surface active agent are contained in a surface active layer, a backing layer, or a overcoat layer of a protective or backing layer.

* * * * *